United States Patent [19]

Sheshtawy

[11] 4,379,494

[45] Apr. 12, 1983

[54] REPLACEABLE DRILL STABILIZER SLEEVE

[75] Inventor: Adel Sheshtawy, Norman, Okla.

[73] Assignee: International Petroleum Engineering Corporation, Noble, Okla.

[21] Appl. No.: 308,490

[22] Filed: Oct. 5, 1981

[51] Int. Cl.[3] ..... E21B 17/10; E21C 9/00

[52] U.S. Cl. ..... 175/325; 308/4 A

[58] Field of Search ..... 308/4 A, 8.2; 175/325

[56] References Cited

U.S. PATENT DOCUMENTS

| | | | |
|---|---|---|---|
| 2,016,042 | 10/1935 | Lewis | 175/325 X |
| 2,589,534 | 3/1952 | Buttolph . | |
| 2,973,996 | 3/1961 | Self . | |
| 3,276,824 | 10/1966 | Carter . | |
| 3,326,305 | 6/1967 | Garrett et al. . | |
| 3,454,308 | 7/1969 | Kennedy . | |
| 3,545,825 | 12/1970 | Hamilton . | |
| 3,642,079 | 2/1972 | VanNote . | |
| 3,754,609 | 8/1973 | Garrett . | |
| 3,818,999 | 6/1974 | Garrett . | |
| 3,993,368 | 11/1976 | Jurgens et al. | 308/4 A |

FOREIGN PATENT DOCUMENTS

| | | | |
|---|---|---|---|
| 1090325 | 11/1980 | Canada | 308/4 A |

*Primary Examiner*—Stephen J. Novosad
*Assistant Examiner*—Joseph Falk
*Attorney, Agent, or Firm*—Jerry W. Mills

[57] ABSTRACT

Drill string stabilizing sleeves (20, 24) are provided for use on a drill string (10) to guide the drill string during drilling. The stabilizer sleeves are replacable and may be manufactured at relatively low cost. Each sleeve includes a cylindrical body (28) having a number of well bore contacting surfaces (34) formed on the outer surface thereof. The surfaces are separated by grooves (38) to permit flow past the stabilizer sleeve. Slots (40, 42) are formed through the cylindrical body on diametrically opposed sides. The slots pass through the well bore contacting surfaces to the inner surface of the body. Flats (44, 46) are provided in opposed sides of the drill string section where the stabilizing is to be performed. Cylindrical segments (54, 56) are positioned within the flats and continue the arc of curvature of the drill string section. Each of the cylindrical segments, in turn, includes a flat (66, 68) for accepting locking blocks (78, 80) inserted through the slots in the cylindrical body (28). The locking blocks secure the cylindrical body in a predetermined position relative to the drill string section and transmits force acting therebetween. Threaded screws (84) may be used to secure the locking blocks to the cylindrical segments. However, these screws are not required to withstand the entire force between the body and drill string section due to the engagement of the locking blades and cylindrical segments.

27 Claims, 5 Drawing Figures

REPLACEABLE DRILL STABILIZER SLEEVE

TECHNICAL FIELD

This invention relates to drilling operations, and in particular to the stabilization of a drill string during drilling.

BACKGROUND ART

In drilling a well, it is conventional to employ a drill bit at the lower end of a drill string. The drill bit is urged against the formation to be drilled and the drill string is rotated to form the well. As the well becomes deeper, additional sections may be added to the drill string from the surface.

In drilling a well, and particularly a deep well, the diameter of the drilling string is very small relative to its length. Consequently, the longitudinal stiffness of the drill string is minimal. The drill string must constantly be kept in tension to prevent buckling. A heavy collar will typically form the lower part of the drill string which has a wall thickness relatively larger than the drill pipe to provide this tension.

The drill bit frequently tends to deviate or depart from straight vertical drilling. The deviation may result from a dip in the formation being drilled or a change in the formation characteristic and is amplified by the minimal longitudinal stiffness of the drill string. In some instances, the lower portion of the drill collar is severly buckled which results in a greater side force being transmitted to the drill bit. Even the collar, which may be several hundred feet in length, will buckle and provide inadequate stiffness and guidance to the drill bit.

Any of these factors or combination thereof may result in an unacceptable rate of well bore deviation. Well bore deviation occurs in every well drilled. A severe deviation can result in a "dog leg" which is a term used in drill operations to denote a deviation beyond the permissible limit.

Well bore deviation has always been a significant problem. With the increase in deep wells in offshore drilling, this problem assumes an even greater importance. Deviation may cause crooked holes, casing wear, key seating, stuck pipe and even breakage of the drilling string. This results in expensive fishing operations and, in a severe case, may cause a total loss of the well.

In an attempt to eliminate well bore deviation, stabilizers have been developed for use on the drill string. A near bit stabilizer is used directly above the drill bit to support the side loads generated by the drill collar buckling to support its length against the well bore formation and reduce the buckling of the drill collar. Stabilizers may also be positioned about the drill collar along its length for support against the well bore formation.

At the present time, stabilizers are either integral with the drill collar or have replacable sleeves or pads. The integral stabilizer may be machined in a short segment of a drill collar or formed by welding blades to the drill collar. These methods are quite uneconomical as the stabilizer must be discarded from the drill string or sent to the shop for redressing when worn.

The existing replacable stabilizers are secured either by threaded connections or compression fit. When a compression fit is employed, the stabilizer requires a hydraulic press for installation and removal. In addition, very close tolerance in machining operations and seal elements are necessary which delay both the installation and replacement on the rig floor and increase the cost of operation.

In one threaded stabilizer, internal threads are machined on the inside of the stabilizer sleeve. A second, matching thread is machined on the outside peripheral of the carrying sub or segment of the drill collar. A third threaded element is machined on the end of the tapered carrying sub which engages and tightens a third element of the stabilizer to achieve the restraint of lateral movement in the stabilizer sleeve. This type of stabilizer results in either a weaker element in the drill collar string if the inside diameter of the drill collar is maintained constant, or restricts the annular flow area through the drill string for flow of circulating fluid if sufficient material thickness is retained after machining the threads or producing a surface sufficient for compression fit on a stabilizer sleeve.

U.S. Pat. No. 4,245,709, issued Jan. 20, 1981 to Manuel illustrates one stabilizer sleeve secured by a friction fit. An outer stabilizer sleeve is threaded over a yieldable sleeve member placed over the drill collar. Cooperating threads between the member sleeves affect contraction of the yieldable sleeve member to secure the stabilizer to the drill collar periphery. This device is not wholy satisfactory. The required machining of the two elements of the stabilizer sleeve with internal and external cooperating threads result in a prohibitive cost for the final product. The depth of the circulation grooves between the stabilizing ribs is reduced to provide sufficient thickness for the external and internal thread machining. Finally, the drilling forces may cause the two elements of the sleeve to unthread, destroying the effectiveness of the stabilizer.

U.S. Pat. No. 3,818,999 issued June 25, 1974 to Garrett discloses a stabilizer having replacable wear pads. The device also has several shortcomings. The well bore annular area is restricted due to the geometry of the stabilizer body. An interruption of the circulating fluid and cutting flow is created by the rotation of vertical linear contact segments. More seriously, the loss of a contact segment in the well bore with integral tungsten carbide or hard metal elements may create severe problems in additional drilling operations. The hard metal may not be milled or removed readily.

Therefore, a need has arisen to provide a replacable sleeve stabilizer which is easy to replace on the rig floor. In addition, the stabilizer should be safer and more effective to use in the well and more economic to manufacture. Finally, the stabilizer should be readily replacable in the field with tools presently available on the rig site.

SUMMARY OF THE INVENTION

In accordance with one aspect with the present invention, an apparatus for stabilizing a drill string in a well bore is provided. The apparatus includes a cylindrical body having at least one well bore contact surface thereon and a slot formed therethrough for positioning at a predetermined location on a section of the drill string. The drill string section has a flat formed therein for alignment with the slot in the predetermined position. A block structure is provided for insertion through the slot and extending from the interior surface of the body proximate the flat. Fastening structure is provided for fastening the block structure to the section of the drill string to secure the cylindrical body in the predetermined position.

In accordance with another aspect of the present invention, the cylindrical body includes a plurality of well bore contact surfaces separated by grooves for passage of circulating fluid. The slot may be formed through the well bore contact surfaces.

In accordance with another aspect of the present invention, slots may be formed through the cylindrical body on diametrically opposed sides of the body. The slots may be trapezoidal in cross section with their length less than the width of the well bore contact surface.

In accordance with yet another aspect of the present invention, a cylindrical segment may be positioned abutting the flat in the section of the drill string. The cylindrical section may have a flat for receiving the inner end of the block structure. The cylindrical segment may also include threaded holes for receiving bolts through the block to secure the block thereto.

BRIEF DESCRIPTION OF DRAWINGS

A more complete understanding of the invention may be had by reference to the following detailed description when taken in conjunction with the accompanying drawings, wherein.

DETAILED DESCRIPTION

Figure 1:
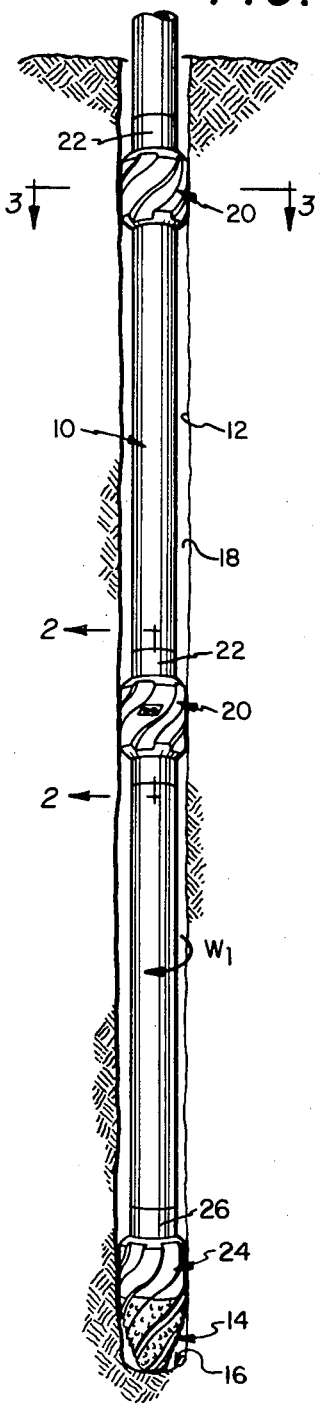
FIG. 1 is a vertical cross section view of a bore hole and a drill string incorporating one embodiment of the present invention.

Referring now to the drawings, wherein like reference characters designate like or corresponding parts throughout several views, FIG. 1 illustrates a drill string 10 within a bore hole 12. The drill string may be rotated in direction $W_1$ by a mechanism at the surface to force drill bit 14 against the drill face 16. This action removes material from the drill face in the bore hole to deepen the hole. Drilling mud or other suitable circulating fluid may be pumped through a hollow passage 15 in drill string 10 to the drill face. The circulating fluid entrains the material from the drill face and brings it to the surface in the annular space 18 between the drill string and well bore.

Positioned on the drill string 10 are two drill string stabilizing sleeves 20. The sleeves 20 are positioned and secured on drill string sections 22 positioned within the drill string. A nearbit stabilizing sleeve 24 is positioned on a drill string section 26 adjacent the drill bit 14. The sleeves and drill string sections combine to form stabilizer assemblies forming one embodiment of the present invention.

Figure 2:
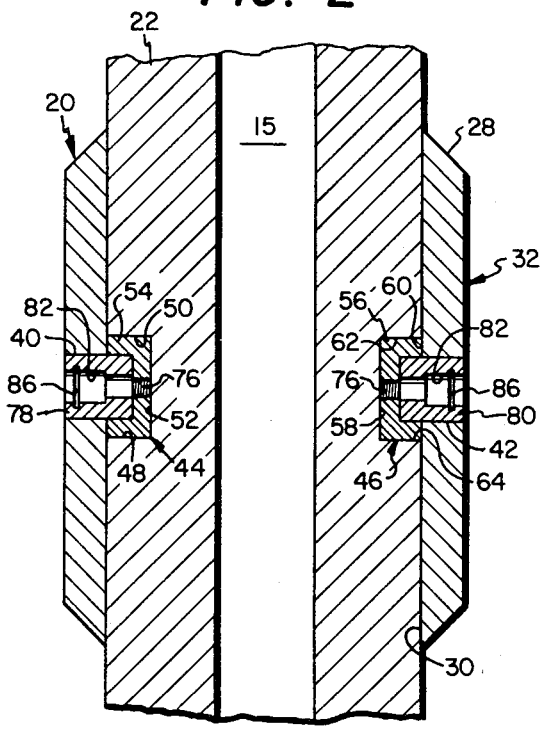
FIG. 2 is a vertical cross section of the drill string taken along line 2—2 in the direction of the arrows in FIG. 1.
Figure 3:
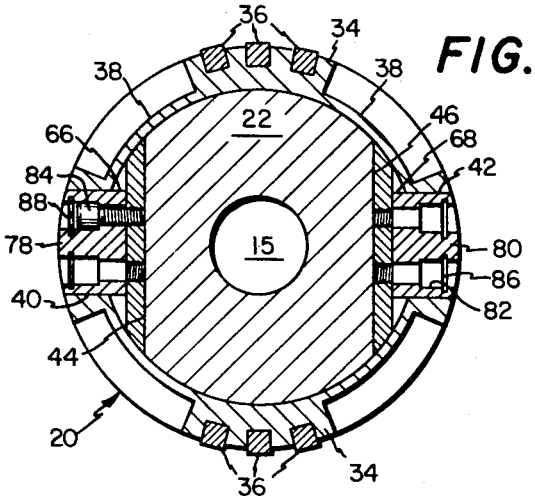
FIG. 3 is a horizontal cross section view of the drill string section taken along line 3—3 in the direction of the arrows in FIG. 2.
Figure 4:
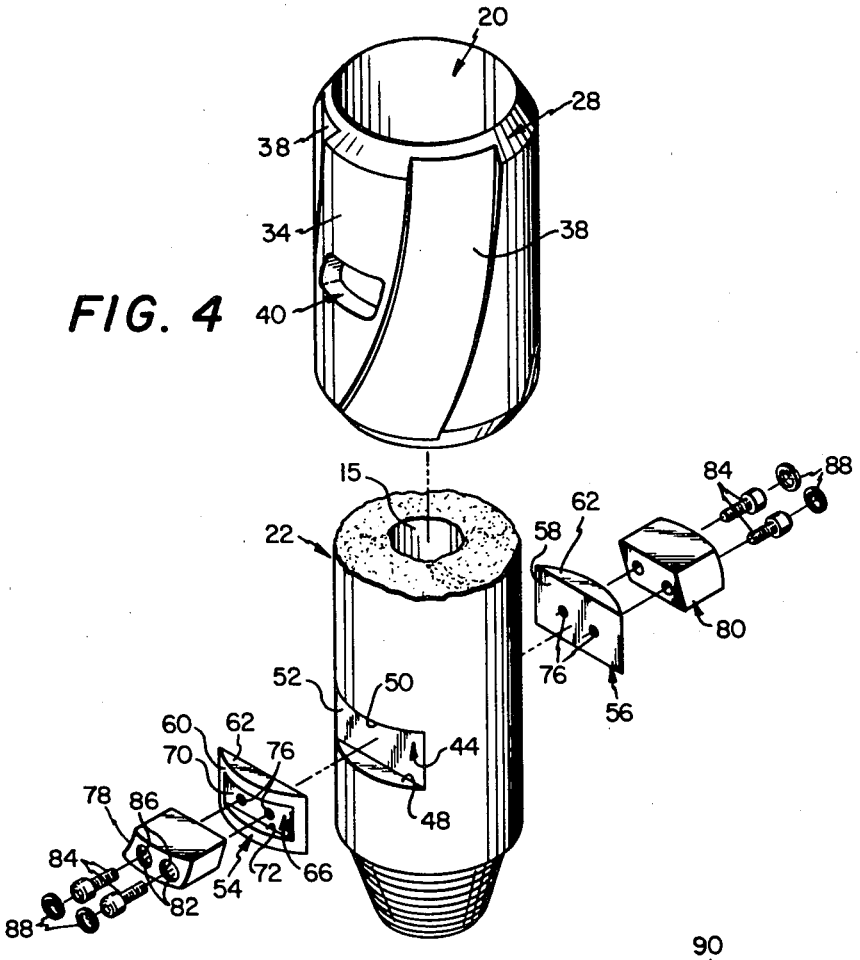
FIG. 4 is an exploded view of a stabilizing sleeve and drill string section forming one embodiment of the present invention.
Figure 5:
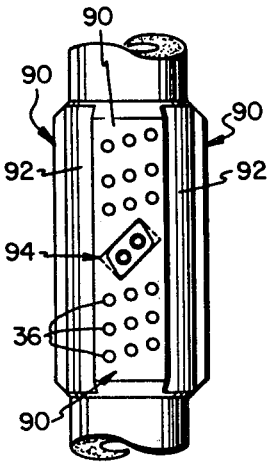
FIG. 5 illustrates a first modification of the stabilizing sleeve having linear vertical well bore contact surfaces.

The construction of the sections 22 and 26 and stabilizing sleeves 20 and 24 are substantially identical and are best described with reference to section 22 and stabilizer 20 illustrated in FIGS. 2–4. Each stabilizer sleeve includes a hollow cylindrical body 28. The inner surface 30 of the body 28 has a diameter equal to or slightly larger than the outside diameter of the associated drill string section. The outer surface 32 of the body 28 includes well bore contacting surfaces 34 having a diameter equal to or slightly smaller than the well bore diameter to contact the well bore walls and guide the drill string within the well bore. The well bore contacting surfaces may be curved along their length such as in the direction of rotation $W_1$ of the drill string as shown in FIGS. 1–4 or linear as shown in FIG. 5. A number of pressed fit tungsten carbide compacts 36 may be positioned within the contacting surface to reduce wear on the stabilizer sleeve during drilling operation.

The well bore contacting surfaces 34 define grooves 38 between the contact surfaces. These grooves will be either straight or curved to follow the contour of the contact surfaces. The grooves permit passage of circulation fluid and debris from the drill face 16 to the surface.

Two slots 40 and 42 are machined through the body 28 on diametrically opposite sides of the body. The slots are preferably formed in a rhomboidal shape with the longest dimension lying in a plane perpendicular to the center axis of the drill string. The slots are preferably machined only through the bore contacting surfaces 34 to minimize structural weakening of the body 28. The edges of the slots along the shortest dimension are inclined to lie parallel to the edges of the contacting surface through which the slot is formed to maintain a minimum separation between the slots and surface edges.

Flats 44 and 46 are machined in both drill string sections 22 and 26. The flats are identical and include side walls 48 and 50 lying in a plane perpendicular to the center axis of the drill string and a bottom wall 52 lying in a plane parallel to the center axis. The flats 44 and 46 are formed on diametrically opposite sides of the sleeves and are positioned to align with the slots 40 and 42 when the stabilizer sleeve bodies are placed in their desired position on the drill string.

Cylindrical segments 54 and 56 are provided to be received within the flats 44 and 46, respectively. Each cylindrical segment includes a flat bottom 58 for abutting bottom wall 52 of each flat. The segments also include outer surface 60 having a radius of curvature. corresponding to the outside surface of the drill string section so that the segment completes the arc of the drill string section when positioned within the flat. The side walls 62 and 64 of each segment are separated by a distance slightly less than the separation of the side walls 48 and 50 of the associated flat to permit the segment to be inserted therein.

Each of the cylindrical segments 54 and 56 also includes a flat 66 and 68. The flats are identical to the flats 44 and 46 in the drill string section in configuration but of reduced dimensions. The flats include a bottom wall 70 and side walls 72 and 74. In addition, two holes 76 are drilled and threaded through each cylindrical segment between the bottom wall 70 and the bottom 58 of the segment.

To install the sleeve on a drill string section, the two cylindrical segments 54 and 56 are placed within the associated flats 44 and 46. The stabilizer sleeve is then slid over the drill string section until the slots 40 and 42 formed therein line up with the flats 66 and 68 in the segments 54 and 56. The sleeve prevents any significant motion of the segments 54 and 56 from the flats in section 22. Rhomboidal locking blocks 78 and 80 may then be inserted from outside the sleeves through the slots 40 and 42, respectively and into the flats 66 and 68.

The rhomboidal blocks are dimensioned in width and thickness to fit firmly within the slots machined in the body 28. The thickness of the locking blocks are also designed to be equal to the distance between the side wall 72 and 74 of each flat 66 and 68. The length of the locking blocks is such that when properly positioned, they complete the arc of the contact surface on the cylindrical body 28.

Two holes 82 are drilled and countersunk through the locking blocks to match the holes 76 in the cylindrical segments. Fasteners, such as hex head cap screws 84 may be threaded into the holes 82 and 76 to secure the locking block to the cylindrical segment. Snap ring grooves 86 may be machined in each countersunk portion of holes 82 to secure snap rings 88 therein to prevent screws 84 from loosening.

It is apparent that the cooperating locking blocks and cylindrical segments will secure and maintain the cylindrical body 28 in a predetermined position on the associated drill string section. Forces acting between the cylindrical body and associated drill string section will be transferred through the locking blocks to the flats of the cylindrical segments. The force will then be transferred between the cylindrical segment and the flats 44 and 46 of the drill string section. Therefore, the screws 84 will act only to secure together the locking blocks and cylindrical segments.

FIG. 5 illustrates a modification of the stabilizing sleeves 20 and 24. In this modification, the well bore contacting surfaces 90 are vertically aligned with the center axis of the drill string. The grooves 92 between the vertical edges of each contacting surface are also vertically aligned. In this configuration, it is desirable to machine the slots 94 with the longest dimension tilted from a plane perpendicular to the center axis to retain the maximum strength in the cylindrical body.

In summary, a stabilizing sleeve has been provided which may be positioned and replaced in the field with tools available on the rig site. Further, the stabilizing sleeve is economical to manufacture and is designed for safe and effective operation within the well bore. The design of the sleeve requires no significant weakening of the drill string section to which it is secured. This permits the cross-section of the hollow core of the drill string to remain substantially constant through the stabilizer sleeve section and permits sufficient thickness to the cylindrical body to insure effective service life.

Although a single embodiment of the invention has been illustrated in the accompanying drawings described in the foregoing detailed description, it will be understood that the invention is not limited to the embodiments disclosed, but is capable of numerous rearrangements, modifications and substitutions of parts and elements without departing from the spirit of the invention.

I claim:

1. An apparatus for stabilizing a drill string in a well bore comprising:

a drill string section for placement in the drill string and having at least one flat formed therein;

restricting means for insertion into the flat on said section to restrict movement parallel to the longitudinal axis of said section, said restricting means having a flat formed therein;

a cylindrical body having at least one well bore contact surface thereon with at least one slot formed through said body, said cylindrical body for mounting at a predetermined position on said section, the flat in said restricting means being aligned with said slot in the predetermined position;

block means for insertion through said slot and into the flat on said restricting means; and fastening means for fastening said block means to said restricting means to secure said cylindrical body in the predetermined position.

2. The apparatus of claim 1 wherein said cylindrical body includes a plurality of well bore contact surfaces thereon separated to form grooves for passage of circulating fluid.

3. The apparatus of claim 1 wherein said cylindrical body has two slots formed on diametrically opposed positions in said cylindrical body.

4. The apparatus of claim 1 wherein said slot is formed through said well bore contact surface.

5. The apparatus of claim 4 wherein said slot has a rhomboidal cross section with its elongate dimension within the boundaries of said well bore contact surface.

6. The apparatus of claim 4 wherein said slot has a rhomboidal cross section with its elongate dimension perpendicular the center axis of the drill string and its short dimension parallel the edges of said well bore contact surface.

7. The apparatus of claim 1 wherein said block means is shaped to fit tightly within said slot and flat and lie flush with said well bore contact surface.

8. The apparatus of claim 1 wherein said restricting means comprises a cylindrical segment means having a flat formed therein, said cylindrical segment means further having means for securing said fastening means thereto, said cylindrical segment means being positioned within the flat formed in said drill string section.

9. The apparatus of claim 1 wherein said drill string section is proximate a drill bit thereon to form a nearbit stabilizer.

10. The apparatus of claim 1 wherein said drill string section is positioned along the drill string to form a drill string stabilizer.

11. An apparatus for stabilizing a drill string in a well bore comprising:

a drill string section having flats formed on diametrically opposed sides thereof for positioning along the drill string;

a cylindrical body having a plurality of well bore contact surfaces thereon, said surfaces being separated by grooves, said cylindrical body having diametrically opposed slots formed through selected ones of said well bore contact surfaces to the interior surface thereof;

cylindrical members for positioning in said flats formed on diametrically opposed sides of said section permitting said cylindrical body to be fitted about said drill string section in a predetermined position, said cylindrical members further having flats formed therein aligning with said slots in said cylindrical body in the predetermined position;

locking blocks for insertion through each of said slots into the flat in said cylindrical members to secure said cylindrical body in the predetermined position;

fastening means for securing each of said locking blocks to a cylindrical member.

12. The apparatus of claim 11 wherein each of said slots has a rhomboidal cross section, the boundaries of said slot lying within the boundaries of the well bore contact surface through which the slot is formed.

13. The apparatus of claim 12 wherein each of said well bore contact surfaces is curved in the direction of drilling, said slot having the elongate dimension thereof lying in a plane perpendicular to the center axis of the drill string.

14. The apparatus of claim 12 wherein each of said well bore contact surfaces is aligned with the center axis of the drill string, the elongate dimension of said slot being inclined from a plane lying perpendicular to the center axis.

15. The apparatus of claim 11 wherein the outer surface of said locking block lies flush with the well bore contact surface when inserted therethrough.

16. The apparatus of claim 11 wherein each of said locking blocks is shaped to fit tightly within the slot and flat through which it is inserted, said fastening means being required only to secure said locking block and cylindrical member together.

17. The apparatus of claim 11 wherein said drill string section is positioned adjacent the bit of the drill string to form a nearbit stabilizer.

18. The apparatus of claim 11 wherein said drill string section lies along the drill string to form a drill string stabilizer.

19. An apparatus for stabilizing a drill string in a well bore comprising:

a drill string section having a curvilinear outer surface forming a portion of the drill string, said section having flats formed on diametrically opposed sides thereof;

cylindrical members for positioning within the flats of said drill section, each of said cylindrical members defining an outer surface for continuing the arc of curvature of the outer surface of said section, said outer surface further having a flat formed therein, said cylindrical member having at least one threaded aperture extending from said flat therein;

a cylindrical body having a plurality of well bore contact surfaces on the outer surface thereof, the boundaries of said well bore contact surfaces being separated by grooves, said cylindrical body being positionable about said section and further having slots formed therein on diametrically opposed sides passing through selected ones of said well bore contact surfaces to the interior surface of said cylindrical body, said slots being aligned with said flats in said cylindrical members when said cylindrical body is positioned in a predetermined position on said section, said cylindrical members being restrained within the flats of said section when said cylindrical body is in the predetermined position;

locking blocks for slidable insertion into said slots and aligned flats in said cylinder member, said locking blocks having at least one through aperture aligned with said threaded aperture in said cylindrical members;

fastener means for insertion through the aperture in said locking blocks and threadably received within the threaded apertures in said cylindrical member for securing each of said locking blocks to each of said cylindrical members to retain said cylinder body in the predetermined position on said section during drilling.

20. The apparatus of claim 19 wherein each of said slots is formed with a rhomboidal cross section, the elongate dimension of the slot being confined within the boundaries of the well bore contacting surface through which the slot is formed.

21. The apparatus of claim 20 wherein the boundaries of said well bore contacting surfaces are curved in the direction of drilling, the elongate dimension of said slot lying in a plane perpendicular to the center axis of the drill string.

22. The apparatus of claim 20 wherein the boundaries of said well bore contacting surfaces are aligned with the center axis of the drill string and the elongate dimension of said slots lie in a plane oblique to the center axis.

23. The apparatus of claim 19 further comprising locking means for locking said fastener means in threaded engagement with said cylinder members to secure said locking blocks and cylinder members together.

24. The apparatus of claim 19 wherein said drill string section is proximate the drilling bit on the drill string to form a nearbit stabilizer.

25. The apparatus of claim 19 wherein said drill string section is positioned along the drill string to form a drill string stabilizer.

26. A method for assembling a stabilizer for a drill string in a well bore comprising the steps of:

positioning cylindrical members in flats formed on diametrically opposed sides of a section in the drill string, the cylindrical members having an outer surface with a flat formed therein, the outer surface forming a continuation of the outer surface of the drill string section when positioned;

fitting a cylindrical body over the section of the drill string, the cylindrical body having a plurality of well bore contact surfaces formed thereon and aligning slots formed therethrough with the flats in said cylindrical members in the drill string section to place the cylindrical body in a predetermined position, the cylindrical body preventing removal of the cylindrical members from the drill string section when in the predetermined position;

inserting locking blocks into each of the slots and into the aligned flats and securing the locking blocks to the cylinder members to secure the cylindrical body in the predetermined position.

27. A method for assembling a stabilizer for a drill string in a well bore comprising the steps of:

forming flats on diametrically opposed sides of a section in the drill string;

positioning cylindrical members in each of the flats in said section of the drill string, the cylindrical members each having an outer surface with a flat formed thereon forming a continuation of the outer surface of said section of the drill string when positioned;

fitting a cylindrical body over the outer surface of said section of the drill string and cylindrical members to a predetermined position, the cylindrical body having a plurality of well bore contacting surfaces formed on the outer surface thereof and having slots formed therethrough aligned with the flats in said cylindrical members in the predetermined position;

inserting locking blocks in each of said slots with the cylindrical body in the predetermined position and into the aligned flats of the cylindrical members and securing the locking blocks to the cylindrical members to maintain the cylindrical body in the predetermined position during drilling.

* * * * *